United States Patent [19]

Meijer

[11] 4,056,150

[45] Nov. 1, 1977

[54] RAM DEVICE

[75] Inventor: Johann Daniël Meijer, Appingedam, Netherlands

[73] Assignee: N.V. Appingedammer Bronsmotorenfabriek, Netherlands

[21] Appl. No.: 647,818

[22] Filed: Jan. 9, 1976

Related U.S. Application Data

[63] Continuation of Ser. No. 252,317, May 11, 1972, abandoned, and a continuation of Ser. No. 495,202, Aug. 6, 1974, abandoned.

[51] Int. Cl.[2] ..... E02D 7/08; E02D 7/10

[52] U.S. Cl. ..... 173/127; 91/276; 173/137; 173/138

[58] Field of Search ..... 91/328, 276, 423, 216 B, 91/40; 173/135, 127, 131, 137, 138

[56] References Cited

U.S. PATENT DOCUMENTS

| | | | |
|---|---|---|---|
| 632,262 | 9/1899 | Gunnell | 91/276 |
| 2,259,379 | 10/1941 | Herzbruch | 91/276 |

*Primary Examiner*—Ernest R. Purser
*Assistant Examiner*—William F. Pate, III
*Attorney, Agent, or Firm*—McGlew and Tuttle

[57] ABSTRACT

A ram device has a drop hammer connected to the piston of a lifting cylinder which is connected by means of short and wide ducts to a control apparatus for admitting compressed air into the cylinder and for discharging the air from the cylinder beneath the piston, control apparatus directly communicating with the ambient air so as to allow a rapid escape of the air through large air vent ports from beneath the piston. In particular this control apparatus is directly mounted on the cylinder, or is included in an extension of this cylinder.

7 Claims, 18 Drawing Figures

RAM DEVICE

This is a continuation of application Ser. No. 252,317, filed May 11, 1972, now abandoned, and a continuation of application Ser. No. 495,202, filed Aug. 6, 1974, now abandoned.

FIELD AND BACKGROUND OF THE INVENTION

For driving piles, pile planks etc., steam rammers have been in use for about a century, in which a drop hammer is connected with the piston of a steam cylinder in order to lift the hammer on admitting steam, which hammer will drop by its own weight as soon as the steam is released.

A disadvantage of such steam devices is that a bulky steam boiler is required, and that it takes a considerable time before the boiler reaches the required temperature, so that during interruptions the heating is often continued which leads to useless fuel consumption. Moreover all sealings, especially for the piston and piston rod, should be resistant to the temperature and corrosive action of steam. An additional disadvantage is the air pollution caused by such steam boilers which are, in general, of a very simple construction, and cannot be heated in the most economic way, and further it is not always possible to use fuel of high quality.

When internal combustion engines become available, which could be used for driving air compressors, it was repeatedly tried to use compressed air instead of steam in such ram devices. These air rammers, however, have not been satisfactory in practice, primarily because of the fact that such devices do not operate with the required speed. When attempting to increase the speed by increasing the air pressure, also the lifting speed increases, so that the hammer will hit its upper stop with a greater impact force which leads to energy losses and possibly to damage. The air rammers now in use are exclusively so called rapid percussion hammers in which compressed air is also used for driving the hammer towards the pile cap.

As appears from U.S. Pat. No. 2,975,761 (1961), improvements of steam rammers are still proposed, which proves that such steam devices still meet the actual needs, as the rapid percussion hammers are not suitable for many purposes.

There are also known repetitive action air hammers, in which a piston is moved in both directions by air pressure, such an arrangement being disclosed, for example, in Gunnell U.S. Pat. No. 6,322,262.

As a substitute for steam rammers so called Diesel rammers have been used for many years, in which the hammer is lifted by an explosion in a lifting cylinder, but it is not possible to make short strokes with such a device, as is necessary for initially driving the top of a pile into the soil, since a short stroke provides an insufficient compression in the cylinder. Moreover such devices produce disagreeable exhaust gases.

SUMMARY OF THE INVENTION

The invention provides a ram device operating with compressed air which can be used in the same manner as the steam devices but without having the disadvantages of all the known devices mentioned above.

The invention is based on the insight that the unsatisfactory operation of the prior art rammers is a consequence of the high flow resistance of ducts and control valves for discharging air from the lifting cylinder. The flow resistance for air in a given duct is considerably higher than that for steam, so that, when a steam device is driven with compressed air, the escape speed of the air is too low, so that the damping of the ram drop hammer is too high. Since there are no air ram devices or drop hammers commercially available which operate satisfactorily, this insight was not obvious.

The invention provides a ram drop device with a ram hammer slidably in guides, which hammer is coupled to a lifting assembly comprising parts to be mutually displaced by means of compressed air, one of these parts being adapted to be connected to a pile cap, which device, furthermore, is provided with a control apparatus by means of which compressed air may be admitted to and discharged from the assembly, in order to lift the ram drop hammer and to let it fall down, respectively. The control apparatus comprises a chamber communicating by means of relatively short and wide ducts with the lifting assembly, and furthermore being adapted to be connected, on the one hand, with an air supply duct by means of a supply valve, and, on the other hand, substantially directly with the ambient air by means of a discharge valve with a relatively large cross-section. These valves are mutually coupled in such a manner that one of them is open when the other is closed.

In order to keep the flow path of the air escaping from the cylinder as short as possible, the control valve will, generally, be mounted on the lifting cylinder. In particular the control valve may be incorporated in a part of the lifting cylinder beyond the range of movement of the piston in this cylinder.

For an understanding of the principles of the invention, reference is made to the following description of typical embodiments thereof as illustrated in the accompanying drawings.

BRIEF DESCRIPTION OF THE DRAWINGS

In the drawings:

FIG. 1 shows in principle a control apparatus according to the invention. An enclosure 1 comprises an air supply chamber 2 and an air discharge chamber 3, the former having a connection 4 for a supply duct, and the latter having a number of connections 5 for ducts leading to the lifting cylinders of a ram hammer.

Figure 1:
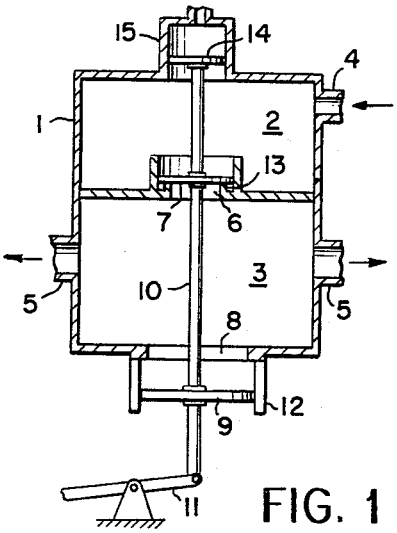
FIG. 1 is a simplified diagrammatic section showing the fundamental construction of a control apparatus according to the invention.

Between the chambers 2 and 3 an aperture 6 and a cooperating valve 7 are provided, and the chamber 3 communicates with the ambient air by means of a discharge aperture 8 and a cooperating valve 9, both valves being interconnected by a valve rod 10, which may be actuated by means of a lever 11 by hand, or automatically in some known manner.

In the position shown, the aperture 6 is closed and the aperture 8 is open, so that the pressure in the lifting cylinders equals the ambient pressure. By lifting the rod 10, the aperture 8 is closed and the aperture 6 is opened, so that both chambers 2 and 3 are put into communication, and compressed air is admitted in the lifting cylinders lifting the ram drop hammer. On lowering the rod 10 again, the aperture 6 is closed and the aperture 8 is opened, so that the air in the lifting cylinders will escape. The aperture 8 has a relatively large cross-section and directly communicates with the ambient air, so that the air may quickly escape from the cylinders, in particular since the ducts between these cylinders and the connections 5 in question are made as short and wide as possible.

The valve 9 is guided, as shown, in open guides 12. Preferably the valve 7 is guided in a closed collar 13 having a sufficiently close fit for ensuring that the aperture 6 is not opened before the aperture 8 is fully closed, and is closed before the aperture 8 is opened.

At the upper end of the rod 10 an auxiliary piston 14 is shown, which is movable in a cylindrical extension 15 of the enclosure 1 for counteracting the pressure on the valve 7 when closed so as to facilitate actuating the rod 10, and, furthermore, counteracting the pressure on the valve 9 when closed so that the latter may be kept closed more easily.

Figure 2:
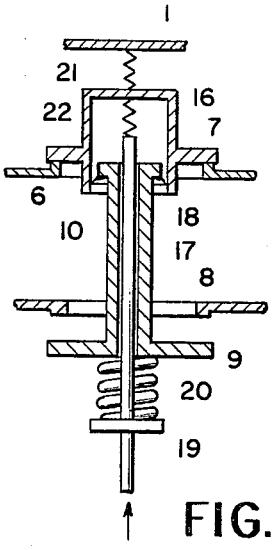
FIGS. 2 and 3 are partial diagrammatic sections of other embodiments of the control apparatus.
Figure 3:
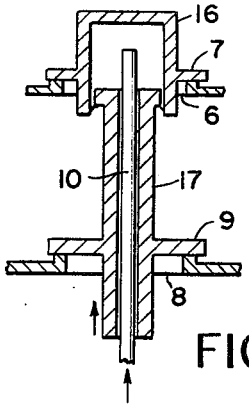
Figure 4:
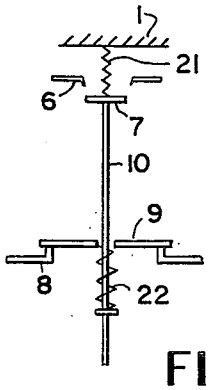
FIG. 4 is a partial diagrammatic section of a further embodiment of the control apparatus.

In the embodiments of FIGS. 2, 3 and 4 the valves 7 and 9 are not rigidly interconnected. In the case of FIG. 2 the valve 7 comprises a cap 16 in which a rod tubular 17 is slidable and is sealed by a sealing rim 18, and which carries at its lower end the valve 9. Within this tubular rod 17 the actuating rod 10 is slidable, rod 10 having a collar 19 below the valve 9, between which collar and valve 9 a spring 20 is provided. By lifting the rod 10 and valve 9 is closed, and subsequently the spring 20 is compressed until the rod 10 reaches the end wall of the cap 16, and then the valve 7 is lifted against the air pressure. The latter movement may be varied by varying the length of the rod 10 above the collar 19. If the weight of the valve 7 is not sufficient, a spring 21 may be provided for resetting this valve.

The embodiment of FIG. 3 corresponds with that of FIG. 2, but the springs are omitted and the rods 10 and 17 are independently movable, for instance by means of a suitable cam assembly.

FIG. 2 shows, furthermore, an additional spring 22 which is charged by the rod 10 when moved upwards, which spring is released as soon as the unilateral pressure on the valve 7 disappears when this valve is slightly opened, so that, then, the valve will be abruptly opened by the spring 22.

FIG. 4 shows a similar construction in which the valve seats have an opposite direction, and in which opening of the valve 9 is accelerated. The springs 22 and 21 have, in this case, the same function as in FIG. 2.

Figure 5:
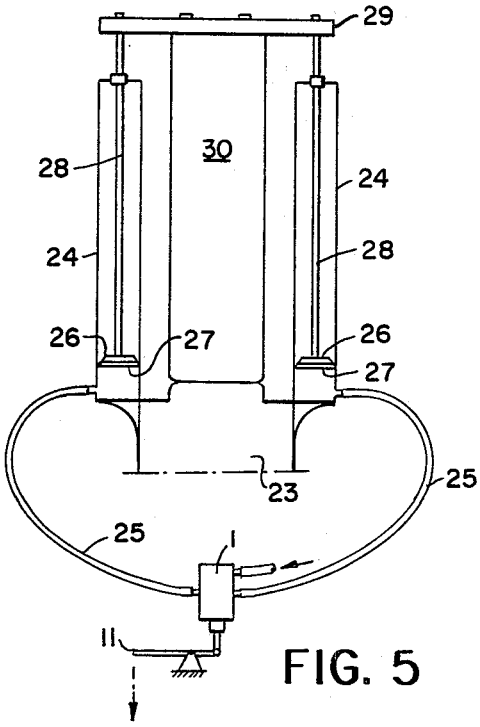
FIG. 5 is a diagrammatic view of an embodiment of a complete ram device according to the invention.

FIG. 5 shows a ram device comprising a control apparatus 1 of the kind described above, and a pile cap 23 with two lifting cylinders 24, which are connected to the apparatus 1 by means of ducts 25. In each cylinder a piston 26 with a sealing rim 27, and a piston rod 28 are movable, which rods 28 are connected to a yoke 29 carrying a ram drop hammer 30. By admitting air to the cylinders 24 this hammer is lifted, and it will fall down again when, under the force of gravity the air is discharged.

Figure 6:
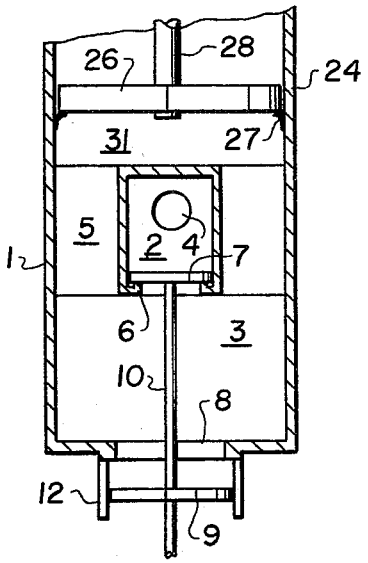
FIG. 6 is a diagrammatic section, corresponding with FIG. 1, of a control apparatus incorporated in a lifting cylinder.
Figure 7A:
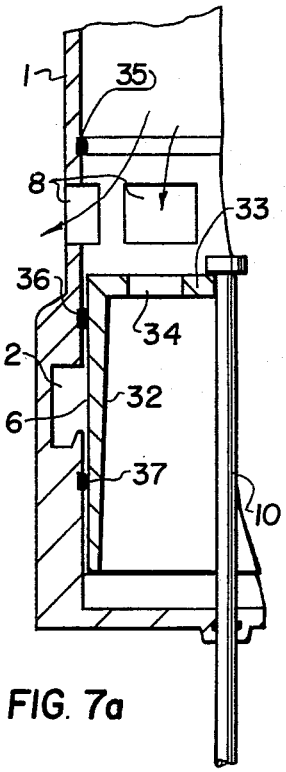
FIGS. 7*a* and 7*b* are sections of a practical embodiment of the assembly of FIG. 6 with a slide valve and respectively showing the slide valve in its lower and upper positions.
Figure 7B:
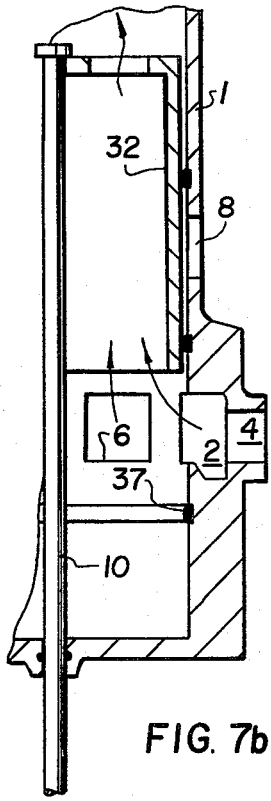
Figure 8A:
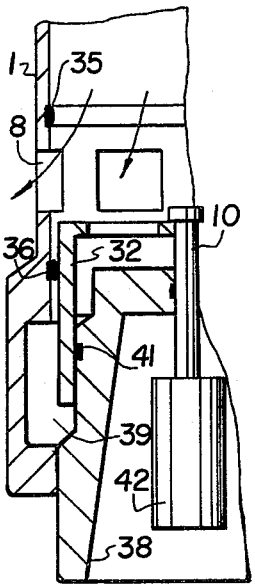
FIGS. 8*a* and 8*b* are sections of another practical embodiment of the assembly of FIG. 6 with a slide valve, and respectively showing the slide valve in its lower position and in its upper position.
Figure 8B:
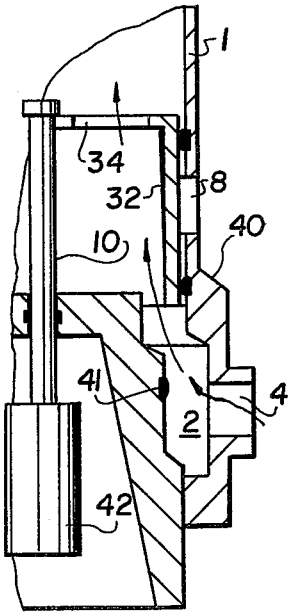
Figure 9A:
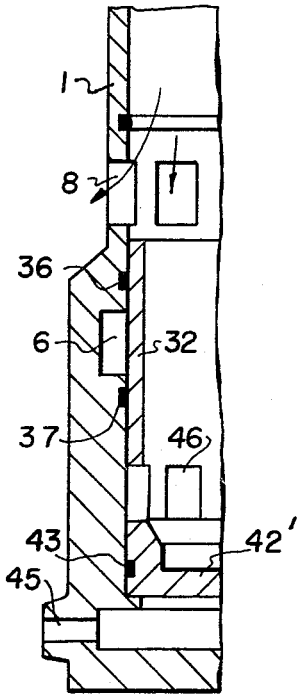
FIGS. 9*a* and 9*b*, 10*a* and 10*b* and 11*a* and 11*b* are sections, corresponding with FIGS. 7*a*–8*b* of assemblies with slide valves to be actuated by compressed air.
Figure 9B:
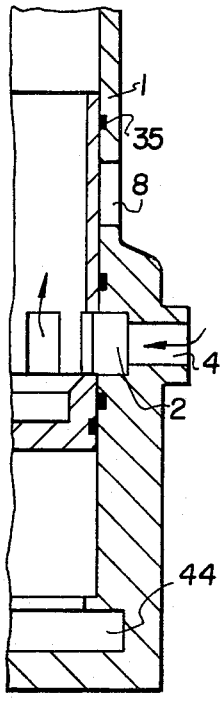
Figure 10A:
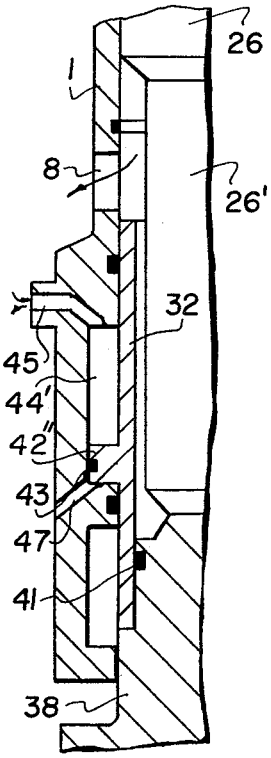
Figure 10B:
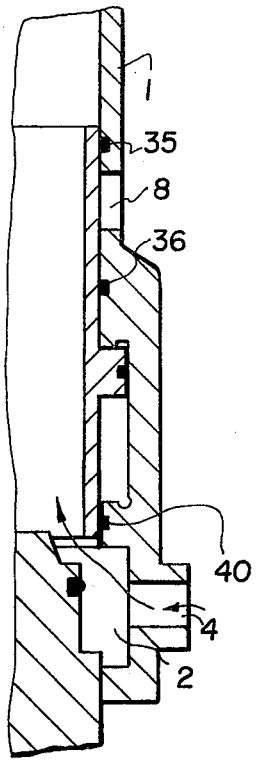
Figure 11A:
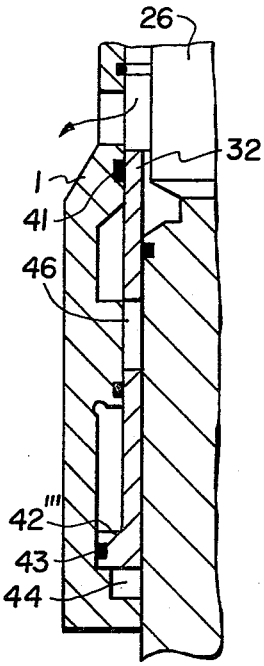
Figure 11B:
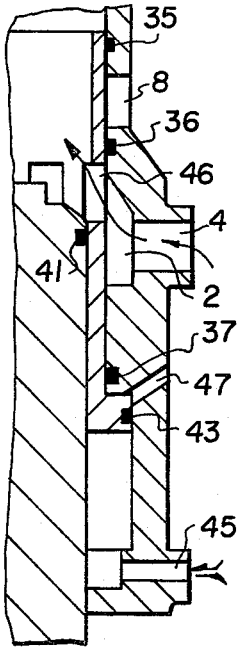

In FIG. 6 a diagrammatic section of another control apparatus is shown which mainly corresponds with the apparatus according to FIG. 1, and the same reference numerals are used for indicating corresponding parts.

A cylinder wall 1 delimiting the control apparatus proper forms, here, the extension of the wall 24 of a lifting cylinder, and in the latter a piston 26 with a piston rod 28 is movable, which piston is sealed in, with respect to the cylinder wall 24, by means of a seal 27. This piston is shown here is about the lowest position.

Beyond the region of movement of this piston 26, the parts of the control apparatus are provided in the cylinder wall portion 1. These parts comprise an inner cylinder 31 which is closed at its upper end, and comprises, at its lower end, an aperture surrounded by a valve seat 6, the latter cooperating with a valve 7 mounted on a valve rod 10. This inner cylinder 31 delimits an air supply chamber 2 in which an air supply duct 4 opens. The lower part 3 of the interior of the cylinder 1 in which the rod 10 is situated corresponds with the middle chamber of the device according to FIG. 1. In the bottom of the cylinder 1 a discharge opening 8 is provided with may be closed by a valve 9, the latter being mounted on the rod 10 and being guided by guides 12. When the rod 10 is lifted, the opening 8 is closed, and the chamber 3 is put in communication with the supply chamber 2.

The space 5 laterally of the inner cylinder 31 forms a connection between the chamber 6 and the interior of the cylinder 24, and, therefore corresponds with the connecting duct between the valve and the cylinder according to FIG. 1.

The operation of the device corresponds completely with that according to FIG. 1, with the exception of the fact that the flow paths for the supplied as well as for the discharged air are considerably shorter, and that the connections may have a larger cross-section so that the flow resistance is reduced very considerably. It will be clear, furthermore, that all the special valve embodiments shown in FIGS. 2, 3 and 4 may also be applied in the present instance.

FIGS. *7a* and *8a* show two particular embodiments of the control apparatus adapted to the arrangement thereof in the extremity of a lifting cylinder. In each half one of the extreme positions of the valve proper are represented. Furthermore corresponding parts are, as much as possible, indicated by the same reference numerals as in FIG. 1. These embodiments are distinguished from that of FIG. 6 in that both valves are substituted for by a single sliding valve body, cooperating with ports in the cylinder wall 1.

FIGS. *7a* and *7b* show an embodiment in which the cylinder wall 1, beyond the region of movement of the piston 26 (FIG. 5), is provided with a plurality of discharge ports 8 which may open directly into the ambient air. At a certain distance from the ports 8 supply ports 6 are provided in the wall 1, which, via an annular supply chamber 2, communicate with the air supply duct 4.

Within the cylindrical wall 1 sliding valve 32 is movable, the transverse surface 33 of which is connected with the driving rod 10, which surface 33 is provided with passages 34. Furthermore, at both sides of the ports 8 and 6, sealing rings 35, 36 and 37 are provided, which are adapted to seal the circumferential wall of the sliding valve 32 with respect to the inner surface of the cylinder or cylindrical wall 1. These rings are shaped in such a manner that an unimpeded movement of the valve 32 remains possible.

In the position of the sliding valve 32 shown in FIG. *7a*, the interior of the lifting cylinder 24 below the piston 26 is communicating with the ambient air through the ports 8. As the valve 32 is lifted, the ports 8 are closed first, but the valve remains sealed by the rings 36 and 37 so that the ports 6 remain closed. As soon as the valve 32 arrives at the upper sealing ring 35, its lower border leaves the lower ring 37. Subsequently the ports 6 are gradually opened and the air may flow from the chamber 2 through the passages 34 into the cylinder space. This situation is shown in FIG. *7b*. On retracting the valve 32, the ports 6 are closed first before the ports 8 are uncovered. The compressed air may, then, escape substantially immediately, so that the piston 26 will move downwardly under the influence of the weight of the ram drop hammer.

FIGS. *8a* and *8b* show a somewhat modified embodiment of the device of FIGS. *7a* and *7b*. In the lower part of the cylinder 1 a central body 38 is arranged extending beyond the ports 6 in the interior of the cylinder 1. Together with the inner wall of the cylinder 1, this body delimits, near the ports 6, an annular passage 39 joining, near the upper parts of the ports 6, a wider passage 40. Just below this widening a sealing ring 41 is provided in the outer wall of body 38. The sealing ring 37 of FIGS. *7a* and *7b* is not present in this case.

In the position shown in FIG. *8a*, the valve 32 contacts the sealing rings 36 and 41, and the passage 40 is completely closed. On lifting the valve this passage remains closed until the lower border of value has left the ring 41. In the meantime the valve has reached the upper sealing ring 35. The connection between the supply chamber 2 and the interior of the cylinder is, in this manner, completely opened, and, conversely, also closing may be effected by a small displacement.

In this manner the stroke of the valve may be reduced.

The rod 10 may, of course, be operated by hand. In case that the ram drop hammer is lifted by means of a number of driving cylinders distributed around the ram hammer this may be objectionable. It is, then, preferred to operate the various rods by means of compressed air. In the case of FIGS. *8a* and *8b*, driving means 42 may be arranged in the interior of the body 38.

FIGS. *9a–11b* show other embodiments which correspond mainly with those of FIGS. *7a*, *7b*, and *8a*, *8b*, in which, however, means for driving the sliding ring valve by compressed air are included in the cylinder 1 too. Corresponding parts have been indicated by the same reference numerals as in the previous FIGS.

In the embodiment of FIGS. *9a* and *9b*, the slide valve 32 is provided at its lower end with a closed piston surface 42', and a sealing ring 43 is provided near this extremity in the wall of the slide valve, and is adapted to sealingly contact the inner wall of the cylinder 1. Below the piston surface 42' a space 44 is present communicating via a duct 45 with a three-way valve or similar control means, not shown, by means of which either pressurised air may be admitted into the chamber 44, or this chamber 44 may be put into communication with the ambient air.

When pressurised air is introduced into the space 44, the slide valve 32 is moved upwards, so that, then, the apertures 8 are closed. Subsequently ports 46 in the wall of the slide valve 32 will register with the ports 6, so that air from the duct 4 can flow towards the interior of the cylinder 1. As soon as the duct 45 is put into communication with the ambient air, the piston 44 is driven downwards by the pressure at its upper side increased by its own weight, so that, then, the ports 6 will be closed again, and, subsequently, the interior of the cylinder 1 is connected with the ambient air through ports 8.

In the embodiment of FIGS. *10a* and *10b*, a central body 38 is provided in the lower extremity of the cylinder 1, delimiting, together with the adjacent part of the cylinder wall, a passage 40 in which the slide valve 32 is movable, and is adapted to sealingly contact this central body by means of a sealing ring 41. In the case shown the piston 26 is constructed as a drop hammer, the lower part 26' of which has a reduced diameter so as to easily fit inside the slide valve 32, so that its extremity may contact the central body. This central body operates as an anvil to be placed on the pile cap or maybe integral with the latter. The drop weight may fall freely on this anvil. This embodiment has the advantage that a single cylinder may be used which is more favorable in smaller devices.

In the embodiment of FIGS. *10a* and *10b*, the slide valve 32 is provided with an external piston 42" which, by means of a sealing ring 43, sealingly contacts the inner surface of a widened part 44' of the cylinder 1. The interior of the chamber 44' above the external piston 42" communicates by means of a duct 45 with a three-way valve or the like in order to connect the chamber 44', as desired, either with the source of pressurised air or with the ambient air.

The embodiment of FIGS. *10a* and *10b* differs slightly from that of FIGS. *9a* and *9b*, in that the lower face of the slide valve 32 is situated in the supply chamber 2, and is, thus, subjected to an upward driving force. Therefore the surface area of the piston 42' is chosen about twice as large as the surface area of the end face of the slide valve 32, so that the latter may be driven downwardly against the pressure in the chamber 2. When, then, the duct 45 is put into communication with the ambient air, the latter pressure will drive the slide valve 32 upwards. An additional aperture 47 connects the part of the chamber 44' below the piston 42" directly with the ambient air. It is, however, also possible to connect this aperture with the three-way valve of the duct 45 in order to amplify the upward drive.

Figure 12A:
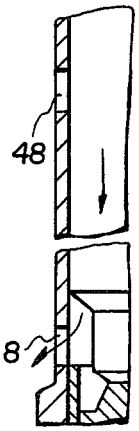
FIG. 12 is the simplified section, on a reduced scale, of a cylinder of a device according to FIGS. 10*a*, 10*b*, or 11*a*, 11*b* with auxiliary discharge ports.
Figure 12B:
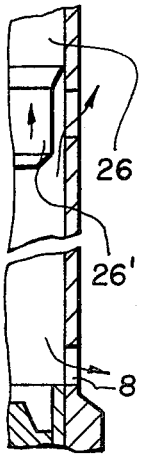

The embodiment of FIGS. *11a* and *11b* corresponds mainly to that of FIGS. *10a* and *10b*, but the drive of the slide valve 32 corresponds with that of FIGS. *9a* and *9b*. Now the external piston 42" is situated at the lower end of this valve, and the drive chamber 44 is formed by the terminal part of the interior of the cylinder 1 which is, however, outwardly widened. The part above the piston 42" is separated from the remaining part of the cylinder by the sealing ring 37, so that, again, a venting aperture 47 is provided in order to obtain an unimpeded movement of the slide valve. The latter valve comprises again the addition of ports 46 of FIGS. *9a* and *9b*. If desired the aperture 47 may be connected with the three-way valve in order to accomplish an accelerated downward movement. FIGS. *12a* and *12b* show a simplified section of a device according to FIGS. 10*a* and 10*b* or 11*a* and 11*b*, in which, in the upper part of the cylinder 1, additional venting ports 48 are provided which are, in general, kept closed by the drop weight 26, but which are opened as soon as the narrower part 26' passes these ports. In this manner it is prevented that, as a consequence of a disturbance in the operation of the slide valve, the drop weight will be driven outside the cylinder 1. In particular these ports 48 may be situated in such a manner that they are liberated when one works with the maximal stroke length so that, then, an accelerated venting takes place as clearly appears from FIGS. 12*a* and 12*b*.

In the embodiments with a drop weight care should be taken that the compressed air, at the beginning of the lifting action, may act on a sufficiently large transverse surface to put into motion the drop weight. For instance the end face of the part 26' may be made larger than the end face of the central body 38, and it is also possible to provide in the latter a spring which, at rest, will lift the drop weight sufficiently for making the whole end face accessible to air.

It will be clear that the auxiliary ports 48 of FIG. 12 will also be present in the device of FIG. 5, and it is also possible to provide such auxiliary ports with corresponding valves which may, for instance, be actuated by means of suitable stops at the beginning of the downward stroke.

The ram device according to the invention has proved to operate as efficiently as a steam device with comparable dimensions and pressure. Particularly the stroke length of the piston 26 and, therefore, the drop height of the hammer may be arbitrarily varied by suitably actuating the control apparatus 1, as in the case of FIGS. 2–4, by adjusting the stroke of supply valve.

Within the scope of the invention many other modifications are possible.

I claim:

1. A pile driving drop hammer comprising, in combination, a vertically oriented cylinder adapted to be mounted above a pile and having a bore and a cylinder wall; a piston movable in said bore; a drop weight connected to said piston and operable, when dropped, to ram ;he pile into the ground; a sleeve valve movable inside said cylinder and operable to cover and to block ports formed in said cylinder wall, said ports including a first set of ports communicating with a supply of pressurized air and a second set of ports communicating directly with the ambient external atmosphere, the ports of at least said second set being distributed around said cylinder wall and having a flow cross-section sufficiently large to offer only a minimal resistance to flow of air therethrough; said sets of ports being spaced apart from each other axially of said cylinder wall; piston means on said sleeve valve movable in a separate part of said cylinder sealingly separated from said bore in which said drop weight connected piston is movable; and control means selectively operable to connect said separate cylinder part to a source of pressurized air to subject said piston means to pressurized air to move said sleeve valve axially of said cylinder; the sleeve part of said sleeve valve having an axial length sufficiently greater than the axial spacing of said sets of ports that, upon axial movement of said sleeve valve, said sleeve part blocks communication between one set of ports and the interior of said cylinder bore beneath said drop weight connected piston before establishing communication between the other set of ports and the interior of said piston bore beneath said drop weight connected piston; said sleeve valve and said sets of ports being relatively arranged in a manner such that, upon establishing of communication between said first set of ports and the interior of said cylinder bore beneath said drop weight connected piston, following blocking of communication between said second set of ports and the interior of said cylinder bore beneath said drop weight connected piston, pressurized air is admitted through said sleeve valve to said cylinder bore beneath said drop weight connected piston to lift said drop weight connected piston and, upon establishment of communication between said second set of ports and the interior of said cylinder bore beneath said drop weight connected piston, following blocking of communication between said first set of ports and the interior of said cylinder bore beneath said drop weight connected piston, the pressurized air escapes directly to the ambient external atmosphere through said second set of ports with a minimum resistance to air flow, until said drop weight connected piston has dropped to its lowermost position to impact said drop weight against the pile to ram the pile into the ground.

2. A pile driving drop hammer, as claimed in claim 1, in which the sleeve part of said sleeve valve is an open ended cylinder having a cylindrical side wall with an annular piston surface extending radially therefrom and constituting said piston means; said cylinder wall having a radially enlarged portion receiving said annular piston surface and constituting said separate part of said cylinder.

3. A pile driving drop hammer, as claimed in claim 2, in which said cylindrical side wall of the sleeve part of said sleeve valve is formed with air admission ports registering, in one extreme position of said sleeve valve, with the ports of said first set.

4. A pile driving drop hammer, as claimed in claim 2, in which said piston is a part of said drop weight, said drop weight having a lower part with a reduced diameter adapted to extend through the sleeve part of said sleeve valve to engage the upper surface of the pile.

5. A pile driving drop hammer, as claimed in claim 3, in which said piston is a part of said drop weight; said drop weight having a lower part with a reduced diameter adapted to extend through the sleeve part of said sleeve valve to engage the upper surface of the pile.

6. In a pile driving drop hammer, control apparatus as claimed in claim 1, in which said cylinder wall is formed with auxiliary discharge ports near the end of the longest upward stroke of said piston, said auxiliary discharge ports communicating directly with the atmosphere.

7. A pile driving drop hammer, as claimed in claim 2, in which the surface of said annular piston surface facing that portion of said radial enlargement of said cylinder wall to which compressed air may be admitted is larger than the transversely extending end surface of said open ended sleeve part of said sleeve valve extending into that portion of said cylinder into which the air for lifting said drop weight connecting piston is admitted through the ports of said first set.

* * * * *